US008479818B2

(12) United States Patent
Rayssiguier et al.

(10) Patent No.: US 8,479,818 B2
(45) Date of Patent: Jul. 9, 2013

(54) METHOD AND APPARATUS TO CEMENT A PERFORATED CASING

(75) Inventors: Christophe Rayssiguier, Melun (FR); Denis Prost, Antony (FR); Mickael Allouche, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 710 days.

(21) Appl. No.: 12/666,495

(22) PCT Filed: Jun. 2, 2008

(86) PCT No.: PCT/EP2008/004523
§ 371 (c)(1),
(2), (4) Date: May 5, 2010

(87) PCT Pub. No.: WO2009/000396
PCT Pub. Date: Dec. 31, 2008

(65) Prior Publication Data

US 2010/0230101 A1 Sep. 16, 2010

(30) Foreign Application Priority Data

Jun. 25, 2007 (EP) ..... 07290791

(51) Int. Cl.
*E21B 33/13* (2006.01)
*E21B 33/14* (2006.01)

(52) U.S. Cl.
USPC ..... 166/290; 166/177.4

(58) Field of Classification Search
USPC ..... 166/285, 290, 51, 177, 278, 305.1, 166/308.3, 380, 381, 279, 281, 283, 305
See application file for complete search history.

(56) References Cited

U.S. PATENT DOCUMENTS 1,910,442 A * 5/1933 Manning ..... 166/289
2,581,070 A 1/1952 Blood (Continued)

FOREIGN PATENT DOCUMENTS

DE 19855048 4/2000
EP 1840324 A1 * 10/2007

(Continued)

OTHER PUBLICATIONS

Kessels, Winfried and Gustav, Zoth, Machine-genrated translation for Borhole Probe for Geohydrology, e.g. for ground water flow measurement, DE 19855048 C1, Apr. 2000.*

*Primary Examiner* — Jennifer H Gay
*Assistant Examiner* — Caroline Butcher
(74) *Attorney, Agent, or Firm* — Michael Dae

(57) ABSTRACT

The invention discloses an apparatus (40) comprising: a setting section (1) surrounded by a first sleeve (2), said first sleeve being expandable and impermeable to a material; an inflating means (1*a*, 3*a*) for inflating said first sleeve, said inflating means ensuring that the first sleeve can be in contact with a first zone (60*a*) of a tube (10) which is permeable to said material, so that said first zone of said tube becomes impermeable to said material; and further comprising a second sleeve portion (4) partially permeable to said material on a second zone (60A') and attached to said first sleeve so that: a path (2*a*) is provided between said first sleeve and said second sleeve portion and so that, when the first sleeve is inflated the second zone can be in contact with said tube allowing the material to flow in the path and through the second zone. Also, the invention discloses the associated method for treatment of a near zone and/or a far zone of a well with the disclosed apparatus.

25 Claims, 17 Drawing Sheets

U.S. PATENT DOCUMENTS

| | | | | |
|---|---|---|---|---|
| 2,922,478 | A * | 1/1960 | Maly | 166/154 |
| 3,270,814 | A * | 9/1966 | Richardson et al. | 166/291 |
| 4,892,144 | A * | 1/1990 | Coone | 277/334 |
| 5,024,273 | A * | 6/1991 | Coone et al. | 166/289 |
| 5,697,441 | A | 12/1997 | Vercaemer | |
| 2003/0111236 | A1 | 6/2003 | Serafin | |
| 2004/0221997 | A1 * | 11/2004 | Giroux et al. | 166/380 |

FOREIGN PATENT DOCUMENTS

| | | |
|---|---|---|
| EP | 1840325 | 10/2007 |
| WO | 2005/088064 | 9/2005 |

* cited by examiner

METHOD AND APPARATUS TO CEMENT A PERFORATED CASING

FIELD OF THE INVENTION

The present invention broadly relates to well cementing. More particularly the invention relates to servicing apparatus for completing downhole wells from a subterranean reservoir, such as for instance an oil and gas reservoir or a water reservoir comprising a liner, a perforated tubular or any type of permeable tubular.

DESCRIPTION OF THE PRIOR ART

After a well has been drilled, the conventional practice in the oil industry consists in filing the well with a metal casing. The casing is lowered down the hole and cement is pumped inside the casing and returns through the annulus where it is allowed to set. Lining the well aims at a dual purpose: preventing the bore walls from collapsing and isolating the various geological strata and thus, avoiding exchange of fluids between them. Furthermore, it can be useful also for different reasons to fill the well with a permeable screen (meaning not impermeable as metal casing) as perforated tubular, tubular with other openings, slotted liner or expandable screen. Use of such permeable screen aims for example in preventing the bore walls from collapsing, and allowing the oil to flow from production zones into the horizontal hole by retaining debris. However, when a permeable screen is present downhole, there is no simple way to cement the annulus. Effectively, conventional technique where cement is pumped inside the casing to be returned through the annulus will not work, because the cement will pass through the first openings of the permeable screen and no cement will be pumped at the other extremity. Further cement would fill the inside of the permeable screen and extra drilling, which is costly and time consuming, and which could damage the screen, would be required after the cement is set. Even this conventional technique does not apply to other types of fluids and there is no simple way to make a treatment to a zone of the borehole behind a permeable screen.

The conventional method consists of installing a temporary setting tube and pumping the fluid through the permeable tube so that it reaches the bottom of the zone to treat. Unfortunately there was no way to ensure the fluid will return through the annulus between the permeable tube and the formation, even if a packer was run at the extremity of the setting tube, then inflated inside the permeable tube. As long as the tube is permeable, the treatment fluid could flow back through the inside of the tube, which greatly reduces the efficiency of the treatment, or which is not desired when the fluid is settable such as cement slurry. In that case, re-drilling would be mandatory after treatment, which represents an important loss of time and can be very damaging for the permeable tube itself, as it is usually slotted or perforated, which makes it weak.

A significant step in the method was reached and described in European patent application number 06290700.1 from the same applicants. A method to circulate a settable or treatment fluid in the annulus 11 outside a permeable tube 10 was described as shown on FIG. 1A. An inflatable bladder 2 to temporary plug the inside of the permeable tube was used. Thanks to this long bladder acting as a mold, the treatment fluid was forced to stay in the annulus outside the permeable tube. The fluid is pumped through a setting tube 1 inside the bladder, and it flows below the bladder. Since the inside of the permeable tube is plugged, the flow is positively forced to circulate through the annulus between the formation 12 and the permeable tube 10. However, there is a risk that the treatment fluid can flow deeper into the well, while the fluid already present in the lower section would return to surface through the annulus around the bladder. This can be caused by the gravity in a vertical or deviated well: the treatment fluid may be heavier than the fluid already in place, so it has a tendency to sink. For example, the treatment fluid can be cement slurry (usual density between 1.6 and 2 g/cm$^3$).

In addition, the treatment fluid is injected into a large area (for instance the tube internal diameter can be 10 to 15 centimeters-4 to 6 inches) and fluid swapping can easily occur in such a large area. As a result, no treatment fluid can be placed at the desired location. A common trick to limit fluid swapping is to make the treatment fluid viscous, so that it can more easily displace the fluid already in place as shown on FIG. 1B. So a viscous fluid is injected in the well through injection port 55. Unfortunately the trick efficiency is not obvious in that particular case, because a viscous fluid would create a larger pressure drop when flowing through the small orifices of the permeable tube. In fact, the less viscous fluid would most probably flow first into the annulus. The treatment fluid should easily flow through the permeable tube, so it needs to be less viscous than the fluid already present in the well. This limitation can be a problem, especially when the treatment fluid is a settable fluid such as cement slurry.

The solution would be a direct injection into the annulus as shown on FIG. 1C, instead of pumping the treatment fluid inside the permeable tube and hoping it will then flow through the tube orifices. In that case, the risk of swapping fluids would be extremely reduced because the annulus size is usually extremely small (about 1 inch thick) compared to the tube internal diameter (4 to 6 inches). But so far no tool is available for such a direct injection.

The last existing solution consists of inflating two packers (also called straddle packer), then injecting the treatment fluid between the packers as shown on FIG. 1D and proposed in U.S. Pat. No. 5,697,441. A tool for treating horizontal wells is made of a pair of expandable packers (2, 2'). The tool is positioned in the well in the vicinity of the permeable tube 10, and the both packers are inflated. After, the treating fluid is injected between the two packers and is allowed to go on the other side of the permeable tube. As the packers are impermeable, the treating fluid fills the annular of the permeable tube all along the packers. The treating fluid can be a settable fluid such as cement slurry. However that solution is obviously more expensive and there is some treatment fluid left between packers. When the fluid is settable such as cement slurry, the packers must be retrieved immediately after injection, before the fluid is set. However the fluid can then flow back inside the permeable tube, preventing an efficient filling of the annulus. Once the cement is set, the cement excess inside the tube must be drilled out, which is time consuming and can damage the tube.

Hence, it remains the need for a method of cementing the annulus or a method of treatment of the earth formation, behind a perforated casing, a slotted liner or an expandable and permeable screen which avoid drawbacks cited therein.

SUMMARY OF THE INVENTION

According to a first aspect of the invention, a method of treatment of a near zone and/or a far zone of a well is disclosed, the well comprises a wellbore, a tube which is permeable to a material, said tube forming an annulus, with the wellbore, the first zone, being inside said annulus and the second zone being beyond the wellbore; and wherein said method comprises the steps of: (i) placing inside said tube a setting section surrounded by a first sleeve, said first sleeve being expandable and impermeable to said material; (ii) inflating the first sleeve so that said first sleeve is in contact with said tube, ensuring for a first zone of said tube impermeability to said material, but leaving a second zone of a second sleeve portion able to be in contact with said tube, permeable to said material, said second sleeve portion being attached to said first sleeve so that a path is provided between said first sleeve and said second sleeve portion; (iii) pumping a treatment fluid to the zones, said treatment fluid passing through said path and through said second zone into said near zone and/or said far zone; and (iv) treating said near zone and/or said far zone with said treatment fluid. Thanks to the presence of the second zone embodied within the second sleeve portion, delivery of the treatment fluid directly through the permeable tube without going inside the tube is possible. In such a way, the inside of the tube is left unchanged after the zones have been treated or consolidated or isolated.

Preferably, the method further comprises the step of deflating said first sleeve so that said first sleeve is no more in contact with said tube near the near zone and/or the far zone; or removing said setting section surrounded by said first sleeve or avoiding deflation of the first sleeve.

Advantageously, the step (ii) of inflating the first sleeve is done such that a third zone of a third sleeve portion able to be in contact with the inside of the tube, is left permeable to said material, said third sleeve portion being attached to said first sleeve on the extremity opposed to the attachment of said first sleeve and said second sleeve portion so that a second path is provided between said first sleeve and said third sleeve portion. Preferably, the method further comprises the step of eliminating an excess of treatment fluid which may enter into the inside of the tube, by pumping a cleaning fluid through the second path and through the third zone into the inside of the tube. Thanks to the presence of the third zone embodied within the third sleeve portion, delivery of the cleaning fluid inside the permeable allows cleaning of the excess of treatment fluid which may enter the inside of the tube after being in the annulus. In such a way, the inside of the tube is also left unchanged after the zones have been treated or consolidated or isolated.

Preferably, in a configuration where the well has a longitudinal axis (A), the step of placing the setting section surrounded by a first sleeve further comprises the step of deploying the first sleeve longitudinally to the axis (A). The first sleeve is arranged like bellows on the setting section and can be deployed on its length to cover the part of the tube or all the tube to be impermeabilized.

In various possible examples of realization, the methods of the invention work when the tube is taken in the list constituted by: perforated casing, perforated liner, perforated tubing, perforated pipe, perforated conduit, slotted casing, slotted liner, screen, expandable casing, expandable screen, tube comprising opening, tube comprising permeable component, and permeable component; when the material is taken in the list constituted by: oil, water, cement, sand, gravel, gas; when the setting section is taken in the list constituted by: coiled tubing, drill pipe; when the delivery section is taken in the list constituted by: coiled tubing, drill pipe; when the sleeve is mainly made of rubber or elastomeric material; when the treatment fluid is a settable fluid or a non settable fluid; when the settable fluid is taken in the list constituted by: conventional cement, remedial cement, permeable cement, phosphate cement, special cement, inorganic and organic sealants, remedial resin, permeable resin, geopolymer materials; when the non settable fluid is taken in the list constituted by: acid, washer, gel, thixotropic fluid.

In the case where the treatment fluid is a settable fluid, the method further comprises the steps of: allowing the treatment fluid to set; deflating the first sleeve so that the first sleeve is no more in contact with the tube near the zones; and removing the setting section with the first sleeve from the zones by putting it out. In a preferred embodiment, the method further comprises the step of: drilling the well with a drilling tool.

In various possible examples of realization, the apparatus of the invention works when the tube is taken in the list constituted by: perforated casing, perforated liner, perforated tubing, perforated pipe, perforated conduit, slotted casing, slotted liner, screen, expandable casing, expandable screen, tube comprising opening, tube comprising permeable component, and permeable component; when the material is taken in the list constituted by: oil, water, cement, sand, gravel, gas; when the setting section is taken in the list constituted by: coiled tubing, drill pipe; when the delivery section is taken in the list constituted by: coiled tubing, drill pipe; when the sleeve is mainly made of rubber or elastomeric material; when the treatment fluid is a settable fluid or a non settable fluid; when the settable fluid is taken in the list constituted by: conventional cement, remedial cement, permeable cement, phosphate cement, special cement, inorganic and organic sealants, remedial resin, permeable resin, geopolymer materials; when the non settable fluid is taken in the list constituted by: acid, washer, gel, thixotropic fluid.

According to a second aspect of the invention, an apparatus is disclosed, the apparatus comprises: (i) a setting section surrounded by a first sleeve, said first sleeve being expandable and impermeable to a material; (ii) an inflating means for inflating said first sleeve, said inflating means ensuring that the first sleeve can be in contact with a first zone of a tube which is permeable to said material, so that said first zone of said tube becomes impermeable to said material; and further comprising (iii) a second sleeve portion partially permeable to said material on a second zone and attached to said first sleeve so that: a path is made between said first sleeve and said second sleeve portion and so that, when the first sleeve is inflated the second zone can be in contact with said tube allowing the material to flow in the path and through the second zone.

In examples of realization, the inflating means is a device delivering a gas and/or a liquid inside the sleeve; is a check valve delivering mud into the inside of the sleeve; is a pump delivering any fluid into the inside of the sleeve. In other examples of realization, the apparatus further comprises a deflating means for deflating the first sleeve, the deflating means ensuring that the first sleeve is no more in contact with the tube and wherein the deflating means is a device releasing the gas and/or the liquid from the sleeve.

Advantageously, the setting section is a tube substantially cylindrical, the first sleeve is attached to the setting section by a first attachment, and the setting section is moveable within the first attachment and is stopped by a shoulder. Also, the second sleeve portion can be attached on one extremity to the first sleeve and on the other extremity to a first cover, said first cover being attached to the first attachment. Also, the apparatus can comprise a first piston moveable on said first attachment, in a first position the first piston allows inflation of the first sleeve and in a second position the first piston allows the material to flow to the path between the first and the second sleeves. Also the apparatus can comprise a second piston moveable on said first attachment, in a first position the second piston allows inflation of the first sleeve and allowing the material to flow through the path between the first and the third sleeves and in a second position the second piston blocks inflation and deflation of the first sleeve.

The deflating means can be an opening at the extremity of the first attachment allowing deflation of the first sleeve, any shearing means to disengage the setting tube from the first attachment.

Preferably, the apparatus further comprises a third sleeve portion partially permeable to said material on a third zone and attached to said first sleeve on the extremity opposed to the attachment of said first sleeve and said second sleeve portion so that: a second path is made between said first sleeve and said third sleeve portion and so that, when the first sleeve is inflated the third zone is inside said tube allowing the material to flow in the second path and through the third zone directly inside the tube. Advantageously, the setting section is a tube substantially cylindrical, the first sleeve is attached to the setting section by a first attachment and by a second attachment on the opposed extremity, the setting section is moveable within the second attachment and is stopped by shoulders respectively on the second attachment and on the setting section. Also, the third sleeve portion can be attached on one extremity to the first sleeve and on the other extremity to a second cover, said second cover being attached to the second attachment. Also, the apparatus can comprise further a third piston moveable on said second attachment, in a first position the third piston blocks the material to flow in the second path and in a second position the second piston allows the material to flow in the second path and through the third zone directly inside the tube.

BRIEF DESCRIPTION OF THE DRAWINGS

Further embodiments of the present invention can be understood with the appended drawings.

DETAILED DESCRIPTION

The present invention involves the use of an expanding sleeve that selectively isolates a portion of a permeable tube such as a perforated casing, or a slotted liner or an expandable and permeable screen, this isolation allowing the further treatment of the annulus zone between the permeable tube and the borehole, such treatment can be for instance a cementing operation to stop or reduce water arrivals in that zone. The typical applications for which the apparatus and method of the invention can be used include sand control and support of wellbore producing formations, in water, oil and/or gas wells. The apparatus and method of the invention can be used also in all type of geometry of wellbores, as highly deviated and horizontal wellbores.

Figure 1A:
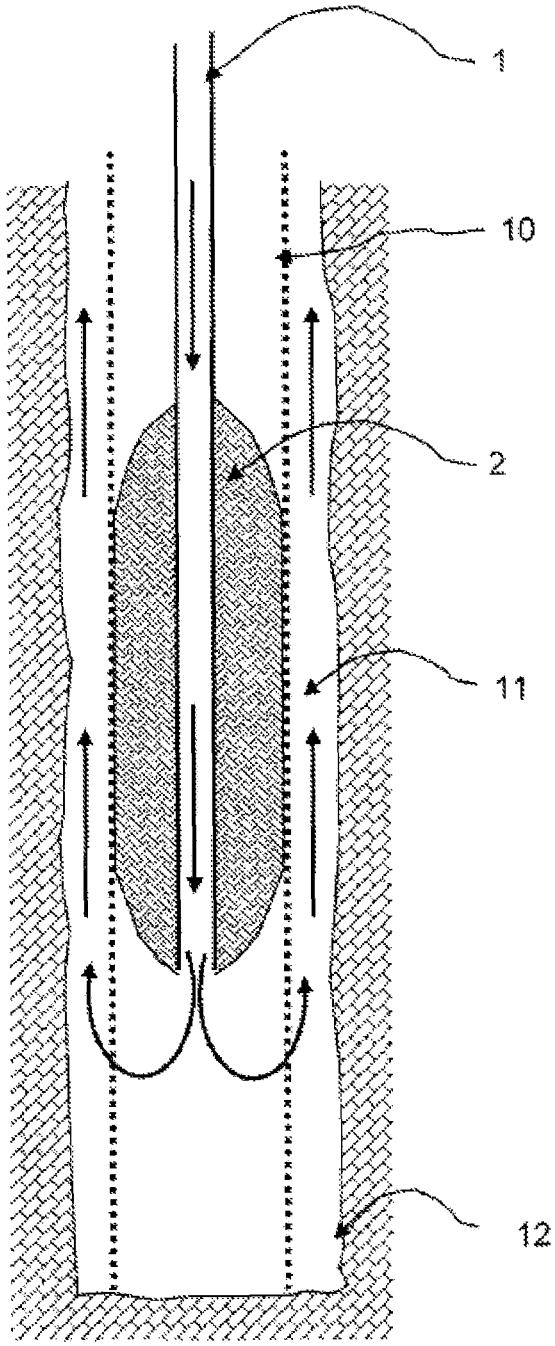
Figure 1A Prior Art
FIGS. 1A, 1B and 1D show a schematic diagram illustrating methods of Prior Art tools.
Figure 1B:
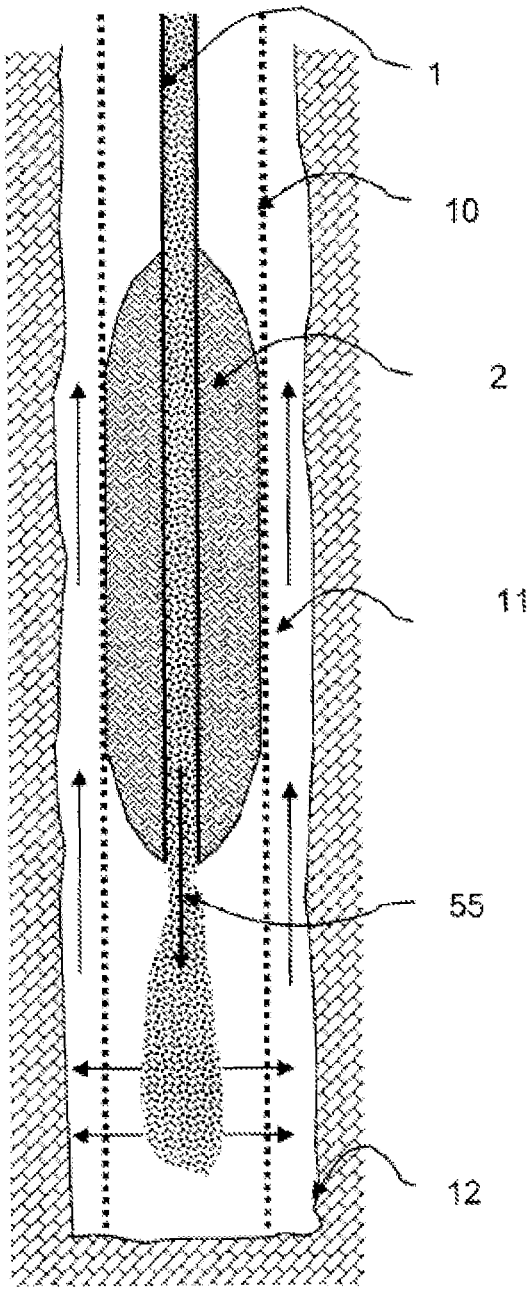
Figure 1B Prior Art
Figure 1C:
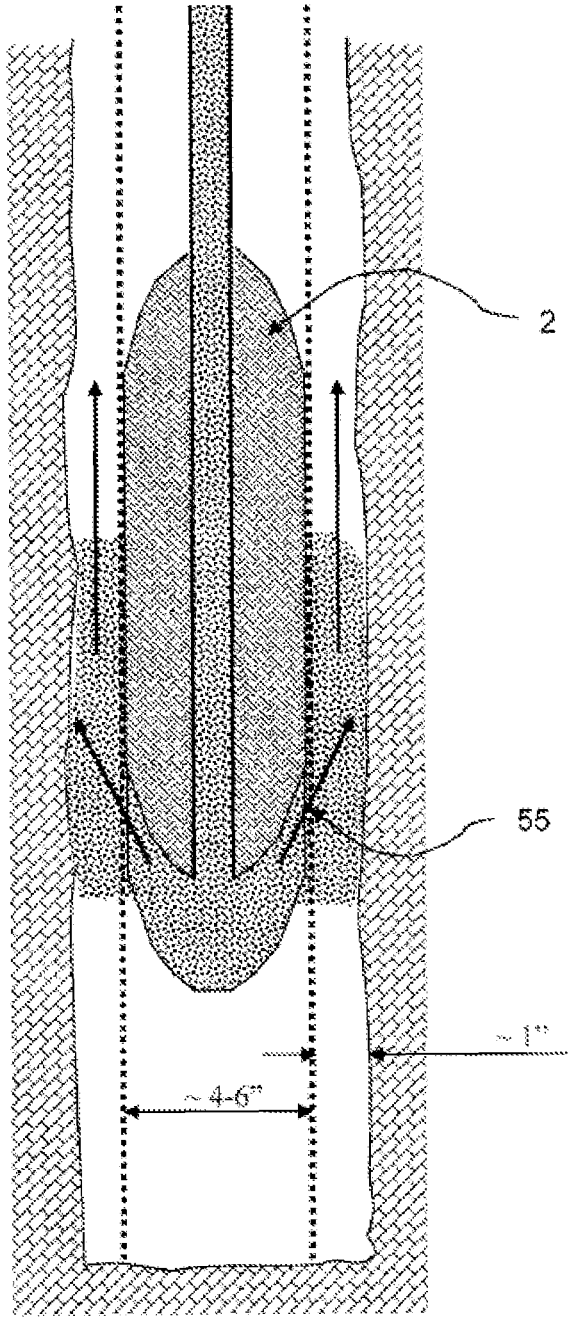
FIG. 1C shows a possible solution never applied in a Prior Art tool
Figure 1D:
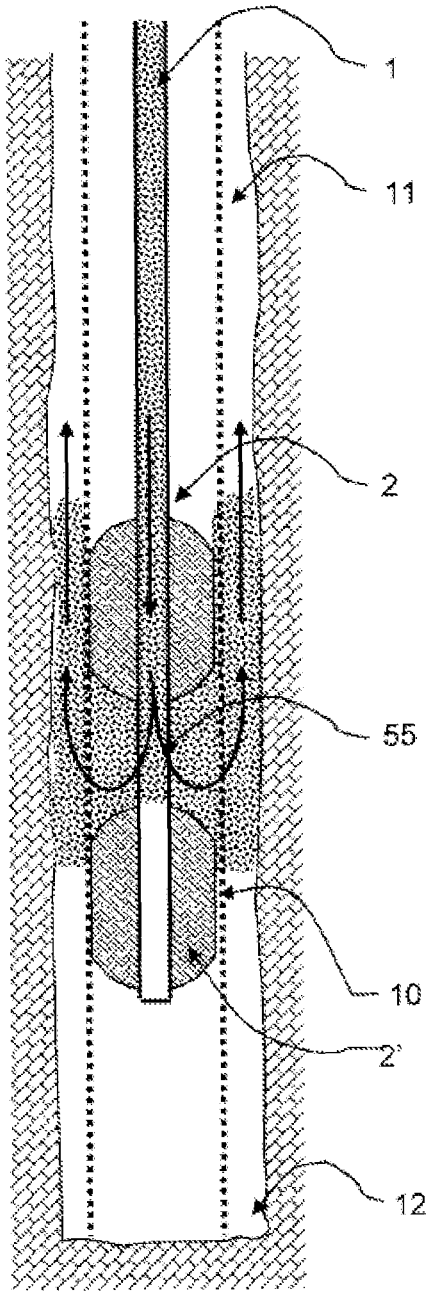
Figure 1D Prior Art
Figure 2A:
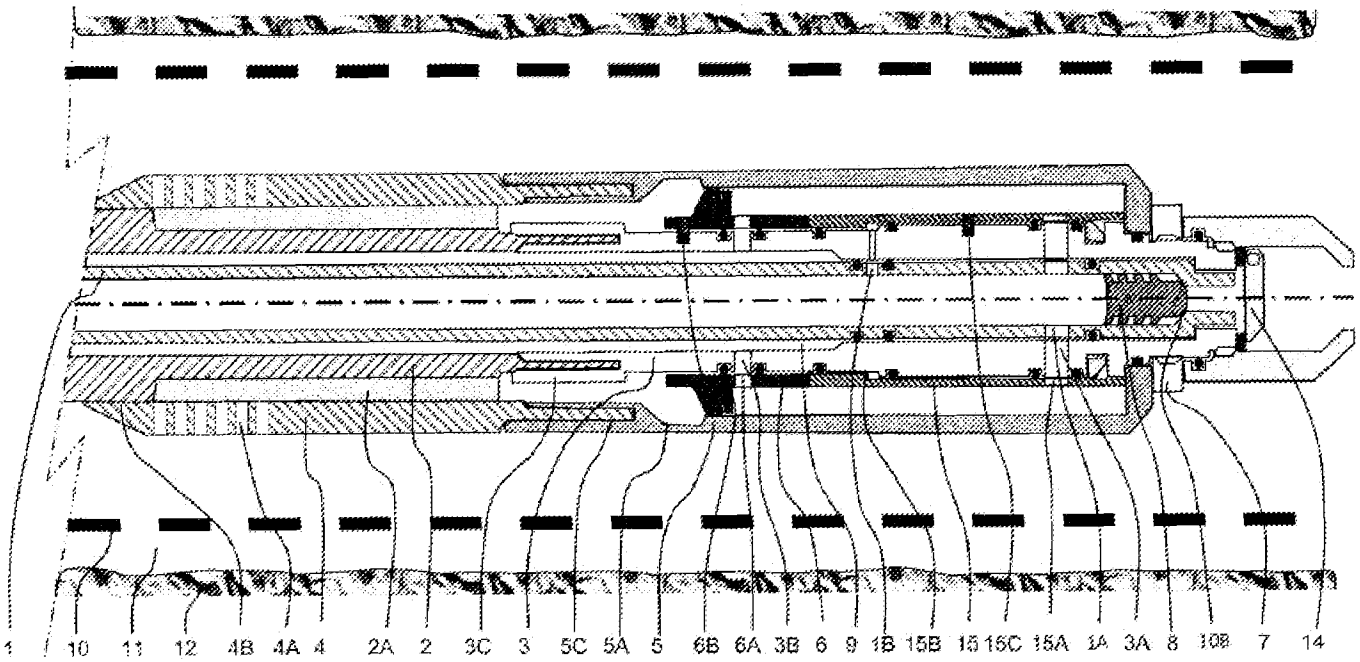
FIGS. 2A to 2C show the bottom part of the tool according to the invention.
Figure 2B:
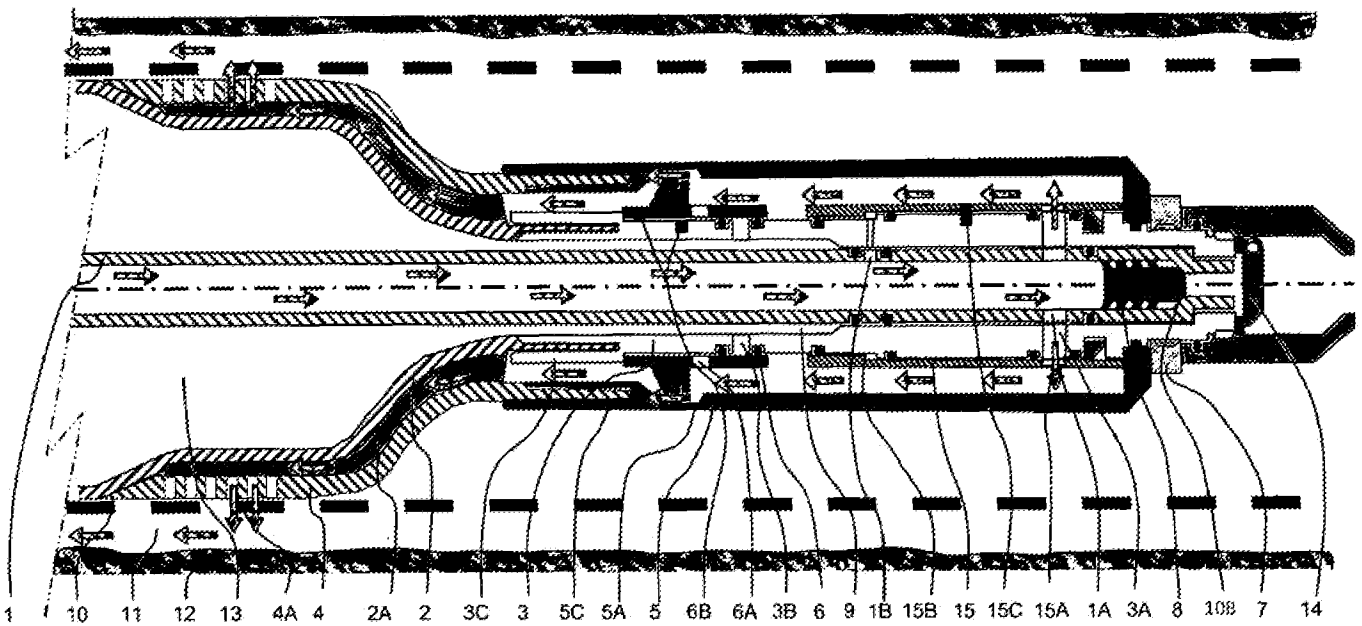
Figure 2C:
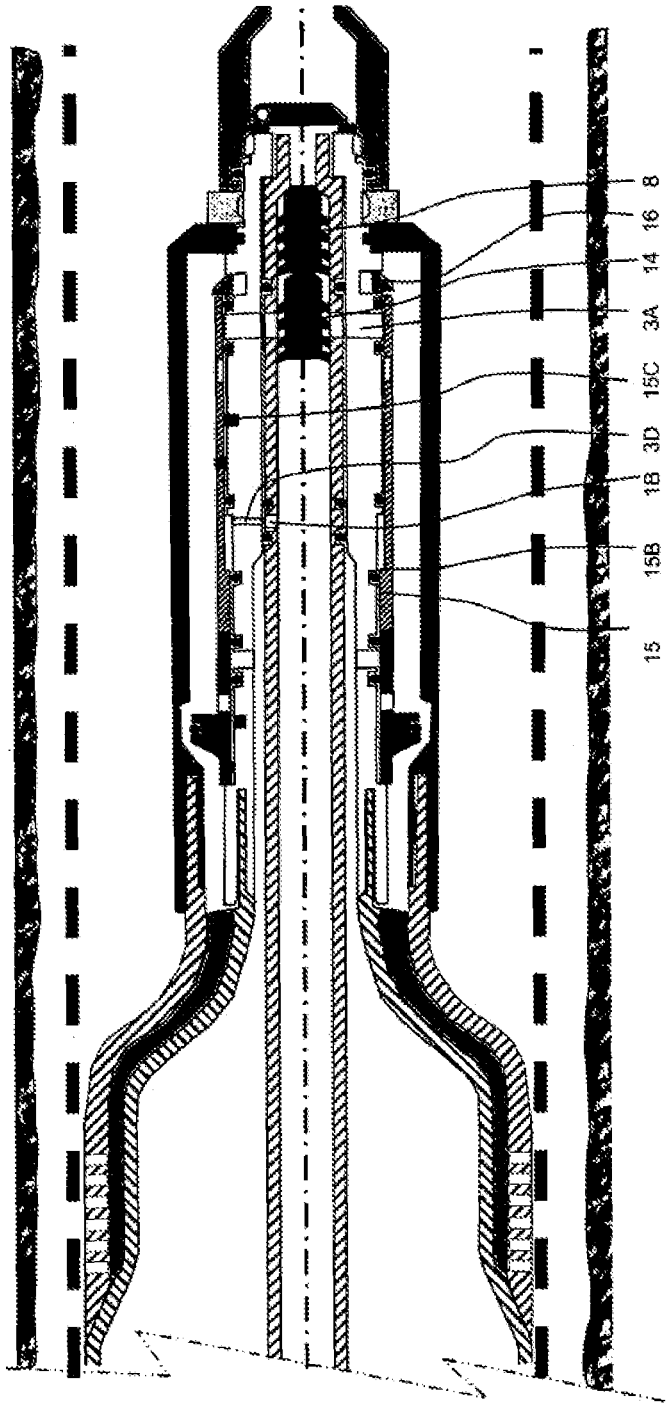
Figure 3:
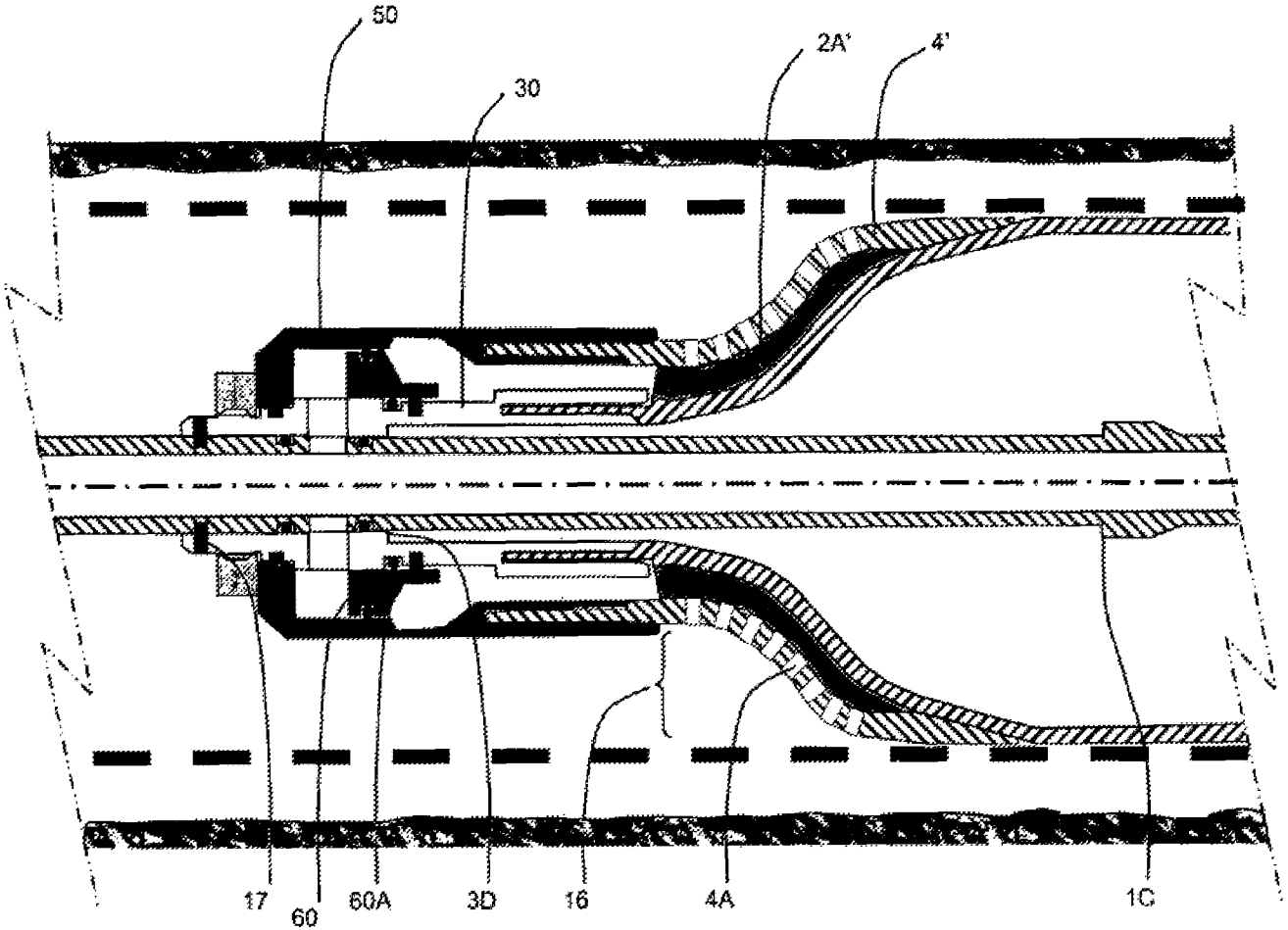
FIG. 3 shows the upper part of the tool according to the invention.

The tool 40 according to the invention is made of a bottom part as shown on FIGS. 2A to 2C and of an upper part as shown on FIG. 3. The bottom part will be first described in details. The tool is use in a well comprising a permeable tube 10. The permeable tube 10 is placed inside the well and forms an annulus 11 between said tube 10 and a wellbore 12. The permeable tube 10 is a perforated tubular, a tubular with other openings, a slotted liner or a screen (standalone, expandable, prepacked, or a perforated tube surrounded by a screen) or any type of tubular with communication means. The tube 10 is at least permeable to one material—permeable, meaning allowing the flowing of said one material through said tube—. Further, the tube 10 can be impermeable or can play the rule of a barrier to another material—impermeable, meaning not allowing the flowing of said another material through said tube—. The tube 10 can also be for example a type of sieve, where the tube allows the crossing of a material or morphology of material, as water or fine sand; and blocks the crossing of another material or another morphology of material, as stone or medium sand.

FIG. 2A shows the bottom part of the tool 40 not deployed within the well. A flexible sleeve 2, for instance a rubber bladder reinforced with an armor (steel and/or Kevlar wires), is placed at the desired position with a setting tube 1. The sleeve 2 is at least impermeable to the said one material that the tube 10 is permeable—impermeable, meaning not allowing the flowing of said one material through said sleeve—. Further, the sleeve 2 can be permeable to another material—permeable, meaning allowing the flowing of said another material through said sleeve—. The armor at its extremity is glued or crimped onto an extremity 3C of an attachment 3. Several slots 2A have been cut into the wall thickness, creating several flow paths. A second sleeve 4, also flexible, for instance a rubber sleeve, covers the extremity of the first flexible sleeve 2, in order to cover all slots 2A, forming in such a way a double-walled extremity. One extremity 4B of the second sleeve is glued onto the main first flexible sleeve 2. Its other extremity is glued or crimped onto an extremity 5C of a cover 5. The cover 5 is a part surrounding the attachment 3 and being secured onto it by a nut 7. Numerous ports or slots 4A have been cut in the second sleeve 4 area which is in contact with the permeable tube 10 when the main bladder is inflated. After inflation, those ports 4A are pressed against the permeable tube 10, opening a flow path to the annulus 11. Alternatively other paths can be obtained with a set of flexible rods located between the first and second sleeves.

One or several ports 1A cut into the setting tube 1 is located in front of port(s) 3A in the attachment 3. A second piston 15 is secured on the attachment 3 by shear screw(s) 15C in the position where its ports 15A are located in front of the ports 3A. A first piston 6 is positioned between the attachment 3 and the cover 5. Ports 6A on the first piston 6 are initially located in front of the ports 3B. The first piston 6 is secured in the initial position by pin(s) 6B. A dart (or a ball) 8 can be pumped from the surface through the setting tube 1 until it lands into a recess 10B to plug the extremity of the setting tube 1. Then a treatment or settable fluid pumped from the surface is able to circulate through ports 1A, 3A, 15A, 6A and 3B, through the space 9 between the setting tube 1 and the attachment 3, to finally inflate the first sleeve 2.

FIG. 2B shows the bottom part of the tool 40 when the first sleeve is inflated. The first sleeve expands until it reaches the permeable tube 10, then it can no longer deform and its pressure rises in chamber 13 defining inner part of the first sleeve. The pressure acts on the first piston 6 between the bore of the cover 5 and the external diameter of the attachment 3, creating a load that tends to move the first piston 6. The geometry of the pin(s) 6B is calculated to shear to a pressure lower than the working pressure of the first sleeve 2. So the pin(s) 6B shears before the pressure could be dangerous for the sleeve, and the first piston 6 translates to close the ports 3B. The first sleeve remains inflated and pressurized. At this point, the shoulder of the first piston 6 is located inside a recess 5A of the cover 5, opening a flow path to the slots 2A. The treatment or settable fluid can now be pumped through the center of the setting tube 1, through the flow path under the attachment 3, through the second sleeve openings, and into the annulus. Actually, the fluid circulates around the first piston 6 inside the recess 5A, between the first and second sleeves 2 and 4, in the slots 2A, through the ports/slots 4A cut in the second sleeve 4, through some perforations of the permeable tube 10 and finally in the annulus 11, as shown by the arrows on FIG. 2B. Once in the annulus, the fluid will return in the direction of the surface, just like any standard cementing job, because the lower section of the well forms a closed volume, already filled with fluid, and the formation/tube annulus is small enough to avoid a double-directional circulation. In this way the tool 40 allows displacing the treatment fluid at the desired location.

FIG. 2C shows the bottom part of the tool 40 when the treatment of the well is finished. When the treatment fluid is entirely pumped, a second dart 14 is launched in the setting tube 1 and a displacement fluid is pumped to push the second dart 14 and the treatment fluid. When the treatment fluid has been placed at its location (in the annulus outside the permeable tube), the second dart 14 lands on top of the first dart 8, closing the ports 3A. Thus the pressure will rise inside the setting tube 1. The ports 1B and 3D are still open, so the pressure acts on the differential area 15B of the second piston 15, creating some load on the second piston. At some point, the pin(s) 15C shears and the second piston 15 will translate until it closes the ports 3A. That extra valve prevents any flow back from the annulus into the setting tube. This is important, because the second dart 14 cannot ensure a perfect sealing in that direction and it may be worn after its travel in the setting tube. An elastic C-ring 16 expands behind the second piston 15 to lock it in the new position: ports 3A closed. In that position, the extremity of the setting tube 1 is perfectly sealed and the setting tube can be pressurized.

FIG. 3 shows the upper part of the tool 40 when deployed within the well. Advantageously, the similar design can be used at the other extremity of the first sleeve 2. A third piston 60 is secured by stronger shear screws 60A, so that they will shear after the bottom of the tool is entirely closed and the setting tube pressurized. The second sleeve has many ports 4A so that the circulation will diffuse uniformly in the space 16 located above the first sleeve 2. Doing so, the circulation will remove any excess of treatment fluid, preventing any undesired setting inside the permeable tube 10. Alternatively, the piston 60 could be replaced by a simple rupture disc installed on the port of the attachment 30. However the fluid circulation would not be as well uniformly distributed as the design with multiple ports and a piston 60. The upper assembly is secured onto the setting tube 1 by shear-able screws or ring 17. At the end of the operation, a straight pull on the setting tube 1 increases the load on that shear-able element as the inflated first sleeve cannot translate easily inside the permeable tube. When the shear-able element shears, the setting tube 1 translates through the inflated sleeve, until a shoulder 1C stops against a recess 3D inside a second attachment 30. In that position the extremity of the setting tube is already entirely disengaged from the bottom assembly as shown on FIG. 4, so that the first sleeve 2 can deflate.

Figure 4:
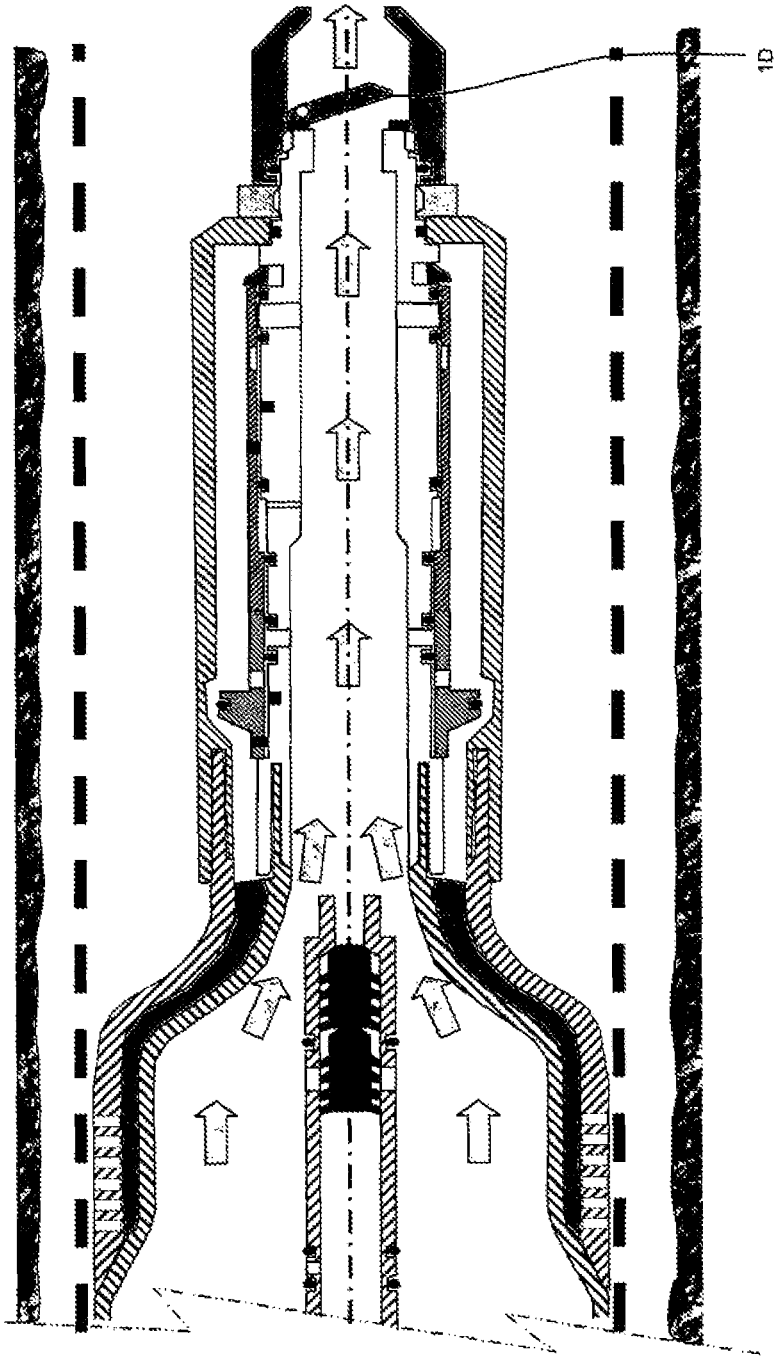
FIG. 4 shows a detail of the bottom part of the tool according to the invention when pulling out of the wellbore is required.

FIG. 4 shows the bottom part of the tool 40 when the treatment of the well is finished and the first sleeve 2 allowed to deflate. Further pulling tends to straighten and collapse the first sleeve, to remove it out of the wellbore. While pulling out of the wellbore, the lower extremity of the first sleeve is widely open because the setting tube 1 has been extracted out of the attachment 3. An opening 1D on the attachment 3 ensures emptying in the well. Thus the first sleeve 2 can easily deflate and collapse. Arrows on FIG. 4 show the deflating step.

Figure 5A:
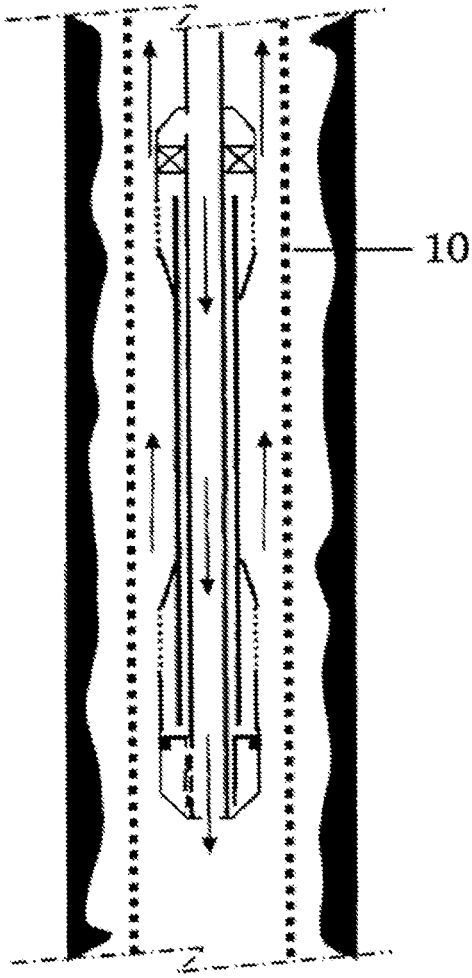
FIGS. 5A to 5G show deployment of the tool according to the invention when used in a wellbore in a preferred embodiment.
Figure 5B:
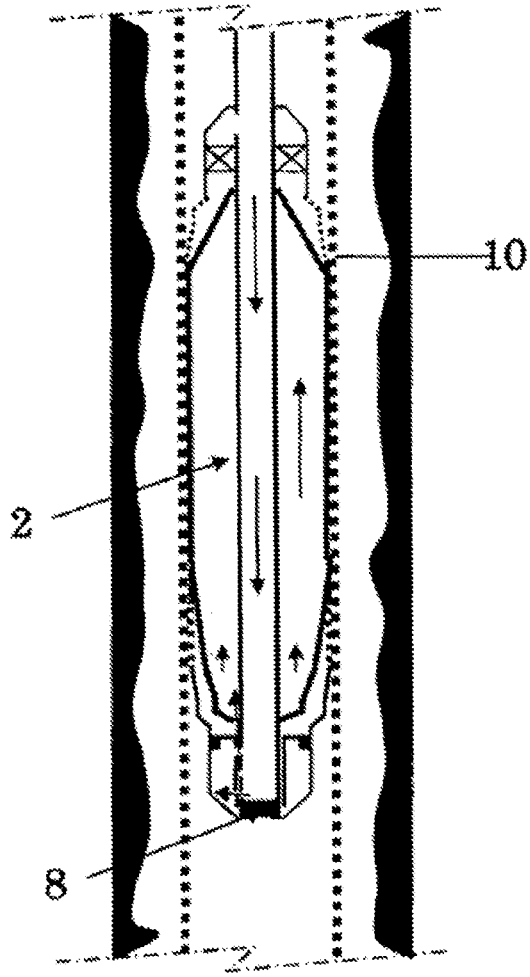
Figure 5C:
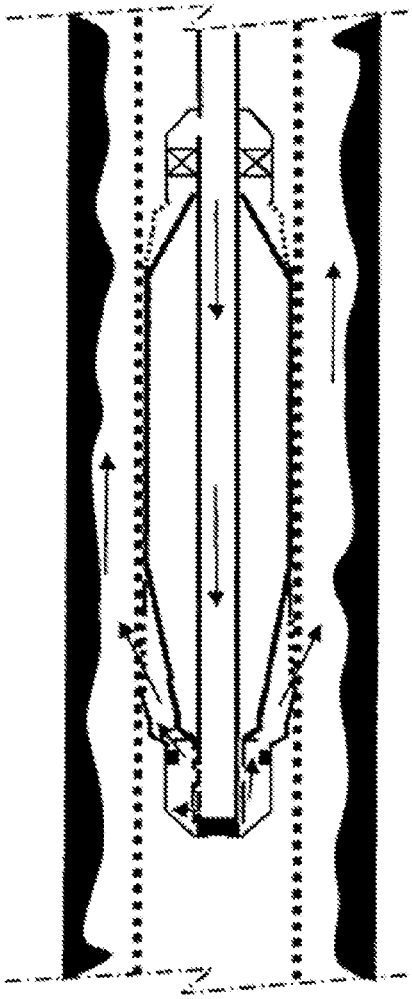

FIGS. 5A to 5B show deployment of the tool according to the invention as disclosed above. In FIG. 5A, the tool 40 is run in the wellbore. The setting tube 1 is usually run in the wellbore with coiled tubing or drill pipes. When running into the wellbore, the setting tube extremity is open, with just a regular check valve assembly for safety. So the well can be conditioned by a direct circulation through the setting string (an indirect circulation is also possible with the tool 40). In FIG. 5B, to trigger the tool 40, a first dart 8 is pumped down the well. It will land at the bottom of the tool, closing the setting tube 1 and forcing the flow to circulate through the tool orifices and to inflate the first sleeve. The first sleeve seals the permeable tube 10 (slotted liner, expandable casing . . . ). Once the tool 40 is fully inflated inside the permeable tube 10, its pressure rises until piston pins are sheared and the piston moves to another position, closing the first sleeve filling port and opening a path through the thickness between the first and second sleeves, allowing a direct injection into the annulus. In FIG. 5C, the treatment fluid can then be displaced around the permeable tube. At the end of the injection, a second dart 14 is pumped down.

Figure 5D:
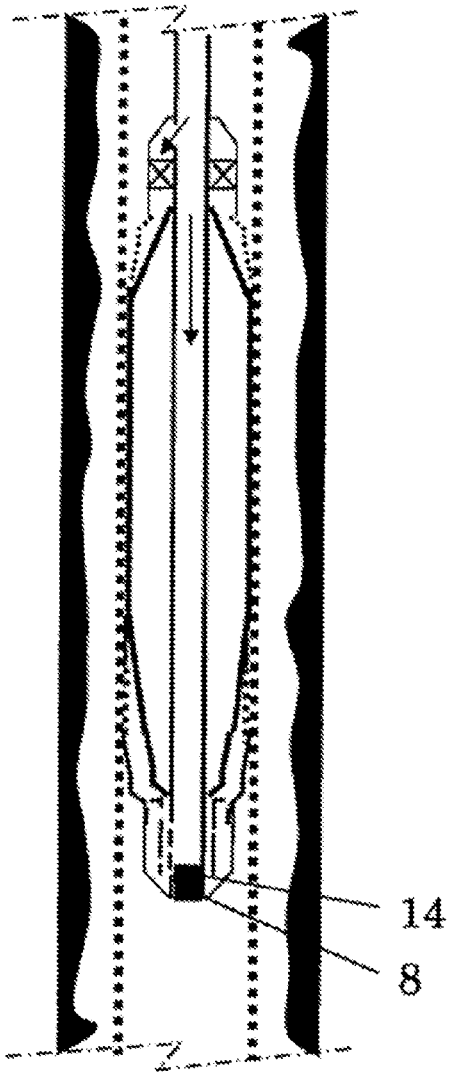
Figure 5E:
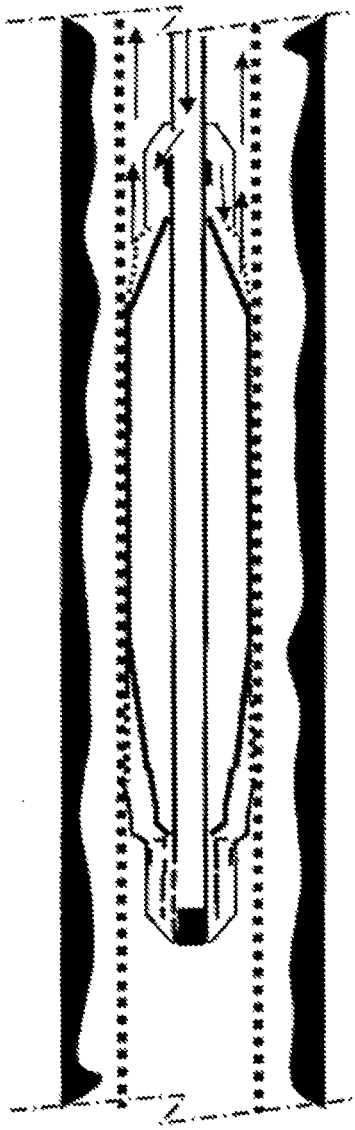
Figure 5F:
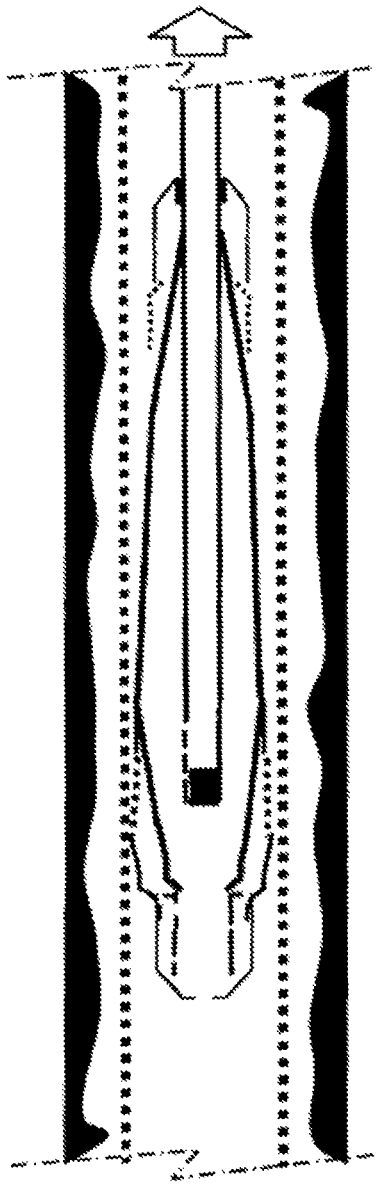
Figure 5G:
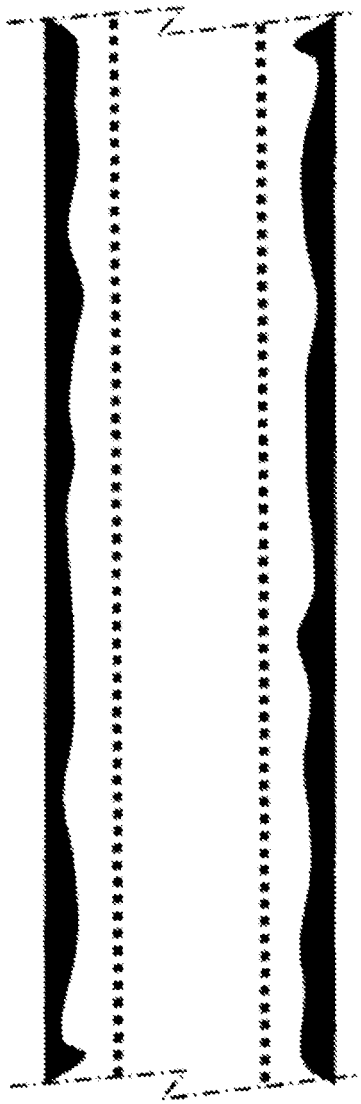

In FIG. 5D, the second dart 14 lands on top of the first one 8, closing the main circulation port. The pressure inside the setting tube will then rise, acting on a second piston that positively closes the injection ports to avoid any flow back by U-tube effect (heavier treatment fluid in the annulus). In FIG. 5E, the pressure rises even more, shearing the pins that maintain the third piston in the upper part of the tool, allowing the circulation through the upper double-walled extremity of the first sleeve. That circulation is diffused through many small ports in order to efficiently displace any treatment of settable fluid that may be located there (if the pumped volume exceeded the annulus volume) before it may set. In FIG. 5F, when the treatment or settable fluid is set or has completed its job, a straight pull on the setting tube disengages its lower extremity from the lower first sleeve attachment 3, bleeding off the first sleeve. The shoulder 1C on the setting tube stops again the upper first sleeve attachment 30, pulling the first sleeve out of the wellbore. In FIG. 5G, the job is finished and the advantage is that there is no need for redrilling.

Accordingly, the tool and its method of deployment is used in a method to treat a well. The method of the invention is a method of treatment of a zone of the well which is located below the permeable tube 10. Zone is defined as a part of the well or a region of the well which is delimited, but which can be quite small—from one cubic meter to ten cubic meters—and which can also be quite large—from hundred cubic meters to ten thousand cubic meters—.

FIGS. 6A to 6G are an illustration of the various steps of the method according to the invention. The method is intended for application in the well. The well is made of a wellbore 12 which is in communication with an earth formation 12C, the earth formation comprising various strata of materials (110, 111 and 112 referring to FIG. 6A). A casing 120 surrounded by an annular space filled with cement isolates the various producing zones from each other or from the well itself in order to stabilize the well or prevent fluid communication between the zones or shut off unwanted fluid production such as water 300. The inside of the well is filled with a fluid 700 which is for example mud, water or crude oil.

Figure 6A:
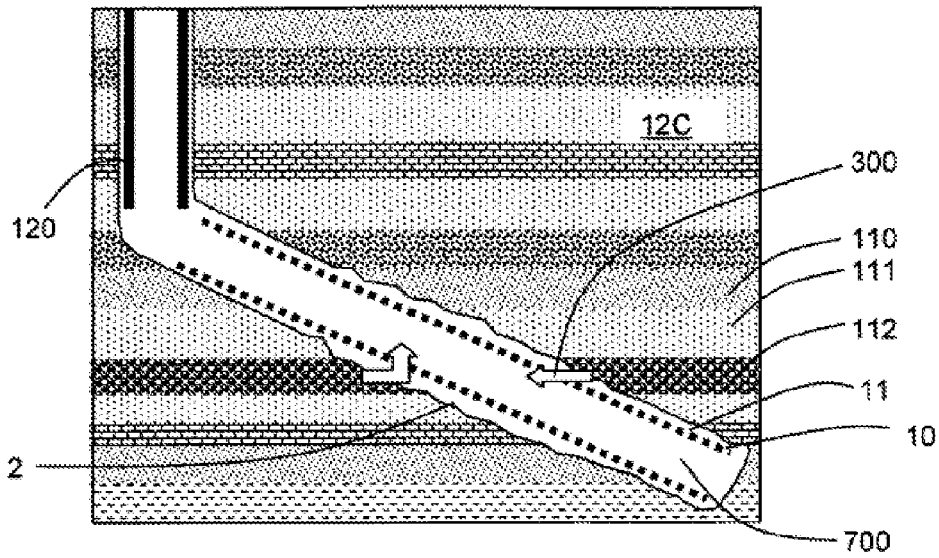
FIGS. 6A to 6G show a schematic diagram illustrating the method of the invention.
Figure 6B:
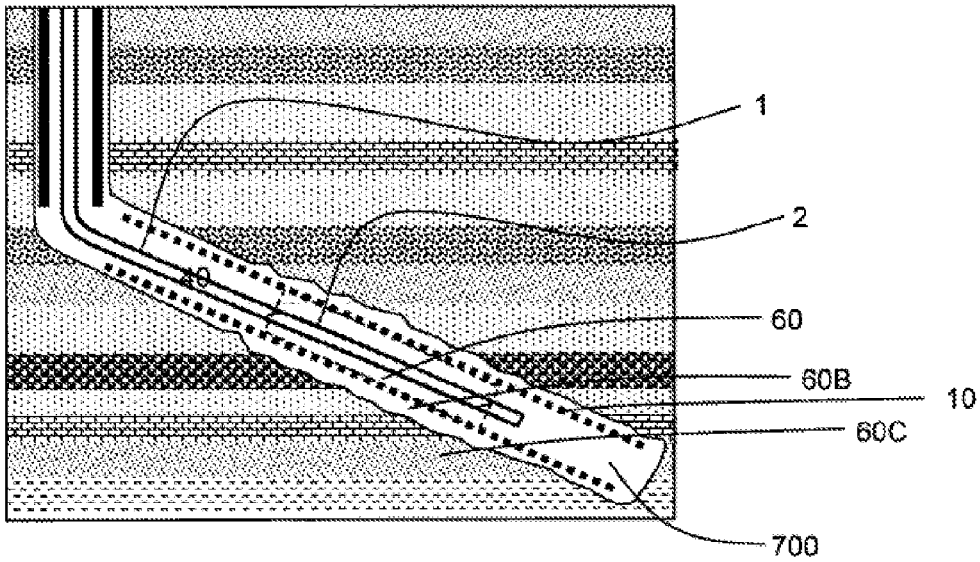

FIG. 6B shows the deployment of the tool 40. The method according to the invention can be deployed when the permeable tube 10 is at the bottom of the well or anywhere in the well, or when the permeable tube 10 is further associated downhole and/or uphole with a casing. When referring to uphole, it is meant going towards the surface and downhole, it is meant going away from the surface. The method of the invention is a method of treatment of a zone of the well which is located below the placed permeable tube 10. Zone is defined as a part of the well or a region of the well which is delimited, but which can be quite small—from one cubic meter to ten cubic meters—and which can also be quite large—from hundred cubic meters to ten thousand cubic meters—. The apparatus 40 is lowered in the well from the surface, it comprises a setting section or setting tube 1. The setting tube at its lower section is surrounded by a first expandable sleeve or bladder 2. Preferably, the sleeve 2 is cylindrical and connected to the setting tube 1 by one connecting means at the upper level and with a second connecting means at the lower level. The connecting means are distant from a fraction of a meter to several meters; preferably the connecting means are distant from a length D varying from 1 meter to few hundred meters; more preferably between 1 meter and 10 meters. As it can be understood when the length D is of some meters (for example up to 10 meters), the lower section with first sleeve can be mounted on the surface, and the apparatus 40 can be lowered and run in the well and finally, deployed when required near the zone to treat. However, when the lower section of the apparatus 40 has an important length D (between 30 meters and 300 meters for example), it is becoming hard to mount the setting tube directly with the first sleeve fully deployed on the surface. In a first aspect of the invention, the lower section of the apparatus 40 has a setting tube already surrounded and mounted with the first sleeve, the assembly being done at the surface or directly at the factory, the apparatus being lowered as such in the well. In a second aspect of the invention, the lower section of the apparatus 40 has a setting tube surrounded with the first sleeve, but not fixedly pre-mounted. The first sleeve alone is deployed inside the well first, then the setting tube is positioned inside said first sleeve. Further, the first sleeve can preferably be arranged as bellows and can be deployed gradually on the setting tube at the surface when lowered into the well or in the well when deploying near the permeable tube. This second aspect of the invention will be explained below in more details.

The first sleeve 2 is positioned inside the permeable tube 10 in a zone 60. The zone 60 delimits the location where the first sleeve 2 has to be positioned to ensure an efficient method of treatment. The zone 60 is defined by a cylinder inside the well, wherein the external surface of the cylinder is delimited by the permeable tube 10. The zone of treatment can be delimited by a near zone 60B and a far zone 60C. The near zone 60B is defined by an annulus surrounding the zone 60, delimited by the permeable tube 10 and the wellbore 12. The far zone 60C is defined by an annulus also surrounding the zone 60B, delimited at one side by the wellbore 12 and stretching into the earth formation 12C from a fixed length L, varying from few centimeters to few meters, preferably the length L is between 2 centimeters to 15 meters and more preferably between 10 centimeters to 5 meters.

Figure 6C:
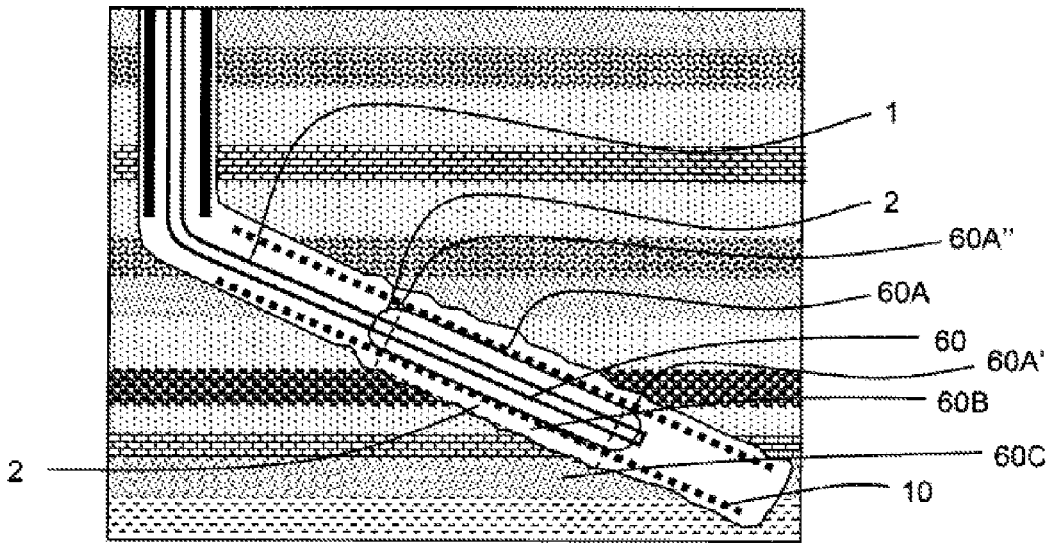
Figure 6D:
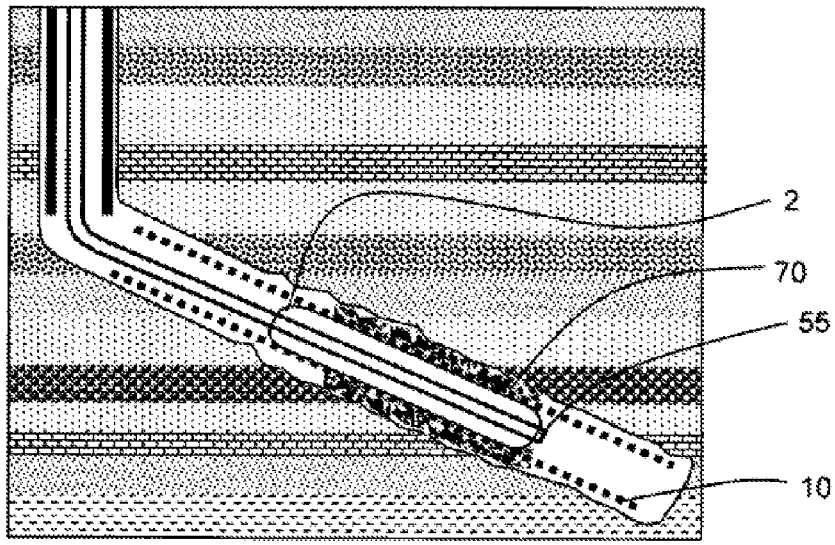
Figure 6E:
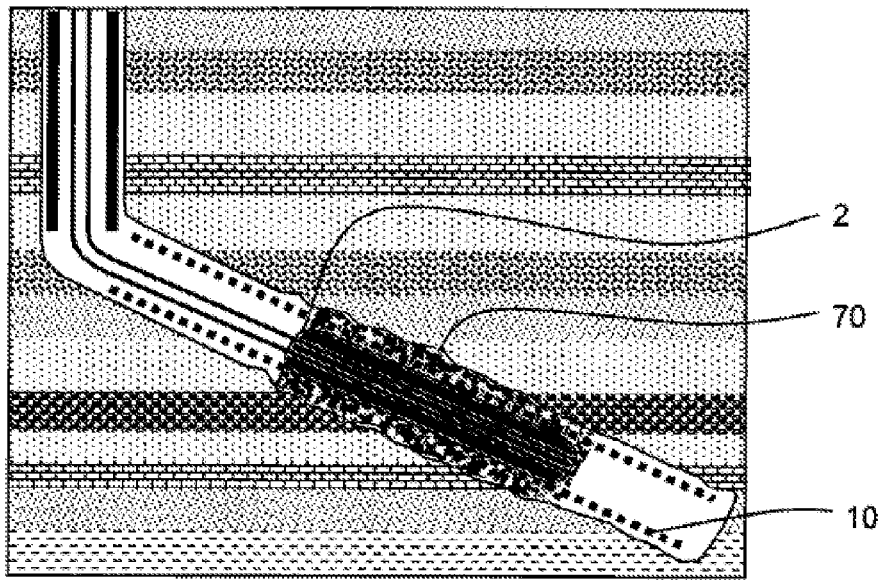

FIG. 6C to 6E show the further step of deployment of the apparatus 40 according to the invention. The first sleeve 2 is inflated thanks to an inflating means located on one connecting means. The inflating means can also advantageously be located on another portion of the tool communicating with the inside of the system {first sleeve and setting tube}. The first sleeve 2 is inflated with a component, which can be mud, water, Nitrogen or any type of gas or liquid. In one embodiment, the inflating means is a check valve or any type of valve allowing circulating mud from the inside of the well into the inside of the first sleeve 2 but not the reverse. In a second embodiment, the inflating means is a pump in communication with the inside of the well delivering mud as component. In a third embodiment, the inflating means is a reservoir delivering gas as component, said gas can be Nitrogen, carbon dioxide or air. In a fourth embodiment, the inflating means are openings between the first sleeve and the setting tube which allow inflation of the first sleeve when component is circulated in the setting tube (such embodiment was already disclosed above). The inflating means can be self activated or activated remotely from surface or activated by a timer or by another device located in the well. When inflated, a part of the first sleeve is in contact with a zone of the permeable tube 10, said contact zone or interface is called first zone 60A. The first zone 60A should be comprised in the surface defined by the intersection of zone 60 and zone 60B. The first sleeve 2 is inflated enough to ensure a tight contact. Said tight contact ensures that the first zone 60A made of the interface first sleeve/permeable tube becomes impermeable to the said one material that the permeable tube 10 is permeable. A second sleeve portion (not shown on the Figures) is attached to said first sleeve 2. The second sleeve portion contains a second zone 60A' which is left intentionally permeable to the said one material—permeable, meaning allowing the flowing of said one material through said second zone—. The second sleeve is attached to the first sleeve so that when the first sleeve is inflated, the second zone 60A' is only in contact with the permeable tube. In such a way, the material can flow from the inside of the setting tube, through a flow path between the first sleeve and the second sleeve, through the second zone 60A' directly in the annulus 11 and to the zone 60B without being poured out inside the permeable tube 10. The material being pumped is a treatment fluid 70. The first sleeve 2 follows the shape of the setting tube when deflated and has a shape practically cylindrical when inflated.

Aim of the impermeabilisation of the zone 60A allows the treatment fluid 70 to rise into the zone 60B instead of rising into the inside of the well via zone 60. Once the entire zone 60B to be treated is filled with the treatment fluid, the pumping of the treatment fluid is stopped. Advantageously, depending on the composition of the treatment fluid 70 and on the composition of the earth formation beyond the wellbore (in the zone 60C), the treatment fluid can, after having filled the zone 60B, flow into the zone 60C. The pumping of the treatment fluid can be re-launched if needed to compensate for the fluid treatment flowing into the zone 60C and re-stopped when required. This step can be further re-executed a number of times, as needed. All along this time, the first sleeve 2 is left inflated, ensuring impermeability of zone 60A, the time needed that the treatment fluid 70 makes its action in zone 60B and/or in zone 60C. As a first example of realization, the treatment fluid can be an acid for acid fracturing of the zone 60C or a chemical activator for activating zone 60C. As a second example of realization, the treatment fluid can be a settable fluid to set in zone 60B and/or in zone 60C, the settable fluid can be a permeable cement, a remedial cement or any type of cement or other sealant e.g. epoxy or furan resin. Further type of treatments can also be combined.

Figure 6F:
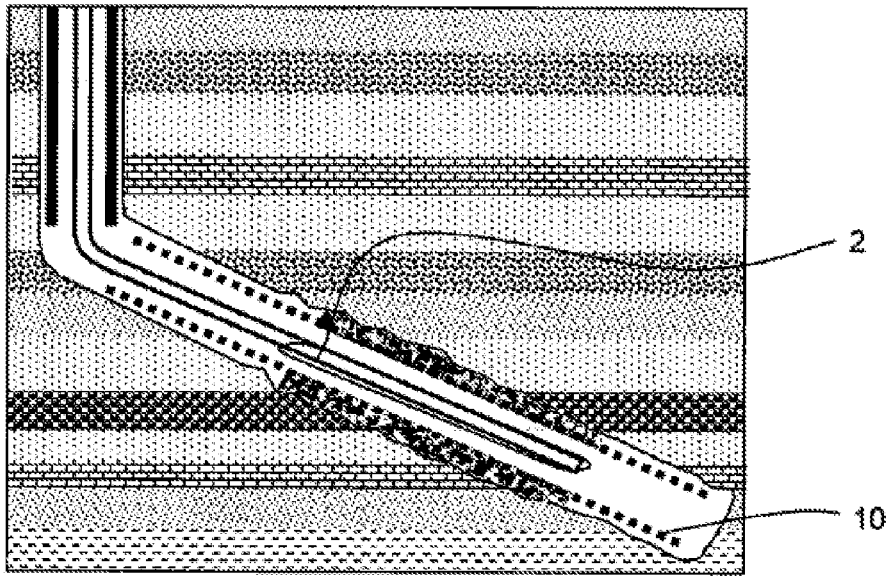
Figure 6G:
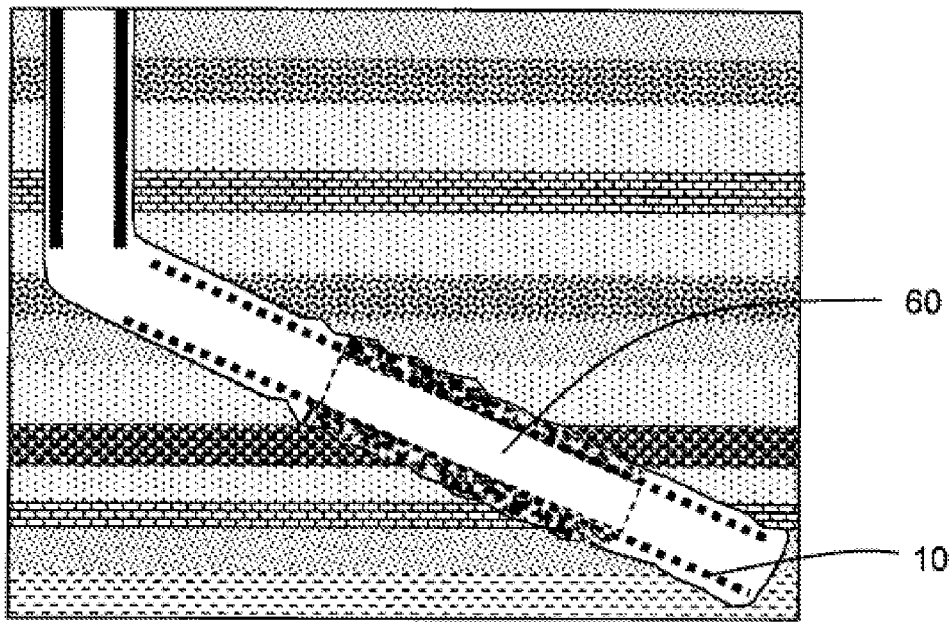

After the zone 60B and/or the zone 60C is treated, the first sleeve 2 is deflated (FIG. 6F). Preferably, the first sleeve 2 is deflated thanks to a deflating means located on one connecting means. The deflating means can also advantageously be located on another portion of the tool communicating with the inside of the system {first sleeve and setting tube}. Preferably, the deflating means and the inflating means are the same means allowing choice between inflation or deflation of the first sleeve. For the first example of realization, when the treatment fluid is a non-settable fluid, but an acid or activator, the deflated sleeve allows the treatment fluid to flow back into the well. Advantage of the use of the tool, is that the treatment of the zone 60B and/or the zone 60C can be done with a lesser quantity of treatment fluid than will be needed without the tool—without the tool, the entire zone 60 would have needed to be filled with the treatment fluid—. For the second example of realization, when the treatment fluid is a settable fluid, the deflated first sleeve leaves the zone 60B and/or zone 60C with the set fluid. Advantage of the use of the tool, is that the inside of the permeable tube 10 is left void of any type of pollution, as set fluid—without the first and second sleeves, the entire zone 60 would have been filled with the set fluid, requiring a further step of drilling the entire zone 60—. FIG. 6G shows the same well as in FIG. 6A after placement treatment with the method and apparatus according to the invention with a settable fluid. The apparatus 40 with the first sleeve 2 has been removed from the well. The zone 60B and/or the zone 60C have been treated and the entire zone 60 remains unaffected by the treatment.

In a further step, a permeable tube can be placed in another zone of the well and said another zone can be treated with the method according to the invention by deploying the apparatus, if for example there are multiple and separated zones in the well or if the zone to be treated is too long to be treated with a single treatment.

The invention claimed is:

1. A method of treatment of a near zone of a well, a far zone of a well, or both, comprising a wellbore, a tube which is permeable to a material, said tube forming an annulus with the wellbore, the near zone being inside said annulus and the far zone being beyond the wellbore; and wherein said method comprises:

(i) placing inside said tube a setting section surrounded by a first sleeve, said first sleeve being expandable and impermeable to said material;

(ii) inflating the first sleeve so that said first sleeve is in contact with said tube, ensuring for a first zone of said tube impermeability to said material, but leaving a second zone of a second sleeve portion able to be in contact with said tube, permeable to said material, said second sleeve portion being attached to said first sleeve so that a path is obtained between said first sleeve and said second sleeve portion;

(iii) pumping a treatment fluid to the zones, said treatment fluid passing through said path and through said second zone into said near zone and/or said far zone; and (iv) treating said near zone, said far zone, or both, with said treatment fluid;

characterized in that the treatment fluid is a settable fluid.

2. The method of claim 1, further comprising: deflating said first sleeve so that said first sleeve is no longer in contact with said tube near the zones.

3. The method of claim 1, further comprising: removing said setting section surrounded by said first sleeve.

4. The method of claim 1, further comprising: maintaining the first sleeve inflated.

5. The method of claim 1, wherein the step (ii) of inflating the first sleeve is done such that a third zone of a third sleeve portion able to be in contact with the inside of the tube, is left permeable to said material, said third sleeve portion being attached to said first sleeve on the extremity opposed to the attachment of said first sleeve and said second sleeve portion so that a second path is provided between said first sleeve and said third sleeve portion.

6. The method of claim 5, further comprising: eliminating an excess of treatment fluid which may enter into the inside of the tube, by pumping a cleaning fluid through the second path and through the third zone into the inside of the tube.

7. The method of claim 1, wherein the well has a longitudinal axis and wherein the step (i) of placing a setting section surrounded by a first sleeve further comprises the step of deploying the sleeve longitudinally to said axis.

8. The method of claim 1, wherein the tube is in selected from the list consisting of perforated casing, perforated liner, perforated tubing, perforated pipe, perforated conduit, slotted casing, slotted liner, screen, perforated tubing surrounded by a screen, expandable casing, expandable screen, tube comprising opening, tube comprising permeable component, and permeable component, wherein the casing is made of steel or composite.

9. The method of claim 1, wherein the material is selected from the list consisting of oil, water, cement, sand, gravel and gas.

10. The method of claim 1, wherein the setting section is selected from the list consisting of coiled tubing, drill pipe and tubing.

11. The method of claim 1, further comprising: allowing the treatment fluid to set; deflating said first sleeve so that said sleeve is no more in contact with said tube near the zones; and removing said setting section with said first sleeve by pulling it out.

12. The method of claim 11, further comprising: drilling out the well with a drilling tool to eliminate any debris.

13. The method of claim 1, wherein the settable fluid is selected from the list consisting of conventional cement, remedial cement, permeable cement, phosphate cement, special cement, inorganic and organic sealants, remedial resin, permeable resin and geopolymer materials.

14. An apparatus for treating a subterranean well having at least one formation comprising:

(i) a setting section surrounded by a first sleeve, said first sleeve being expandable and impermeable to a material;

(ii) an inflating means for inflating said first sleeve, said inflating means ensuring that the first sleeve can be in contact with a first zone of a tube which is permeable to said material, so that said first zone of said tube becomes impermeable to said material; and characterized by further comprising (iii) a second sleeve portion partially permeable to said material on a second zone and attached to said first sleeve so that:

a path is made between said first sleeve and said second sleeve portion and so that, when the first sleeve is inflated the second zone can be in contact with said tube allowing the material to flow in the path and through the second zone, wherein the first and second sleeves are inflated by a fluid that is pumped into the apparatus from a surface location;

wherein fluid is further ejected from the apparatus into zones in the subterranean well.

15. The apparatus of claim 14, further comprising a deflating means for deflating the first sleeve, said deflating means ensuring that the first sleeve is no more in contact with said tube.

16. The apparatus of claim 14 wherein the setting section is a tube substantially cylindrical, the first sleeve is attached to the setting section by a first attachment, the setting section is moveable within the first attachment and is stopped by a shoulder.

17. The apparatus of claim 16, wherein the second sleeve portion is attached on one extremity to the first sleeve and on the other extremity to a first cover, said first cover being attached to the first attachment.

18. The apparatus of claim 16, comprising further a first piston moveable on said first attachment, in a first position the first piston allows inflation of the first sleeve and in a second position the first piston seals the first sleeve and allows passing of the material to the path.

19. The apparatus of claim 18, comprising further a second piston moveable on said first attachment, in a first position the second piston allows inflation of the first sleeve and passing of the material to the path and in a second position the second piston seals the communication with the setting section to prevent any flow through the path.

20. The apparatus of claim 19, comprising further a third piston moveable on said second attachment, in a first position the third piston blocks the material to flow in the second path and in a second position the second piston allows the material to flow in the second path and through the third zone directly inside the tube.

21. The apparatus of claim 14, further comprising a third sleeve portion partially permeable to said material on a third zone and attached to said first sleeve on the extremity opposed to the attachment of said first sleeve and said second sleeve portion so that: a second path is made between said first sleeve and said third sleeve portion and so that, when the first sleeve is inflated the third zone is inside said tube allowing the material to flow in the second path and through the third zone directly inside the tube.

22. The apparatus of claim 14, wherein the setting section is a tube substantially cylindrical, the first sleeve is attached to the setting section by a first attachment and by a second attachment on the opposed extremity, the setting section is moveable within the second attachment and is stopped by shoulders respectively on the second attachment and on the setting section.

23. The apparatus of claim 21, wherein the third sleeve portion is attached on one extremity to the first sleeve and on the other extremity to a second cover, said second cover being attached to the second attachment.

24. The apparatus of claim 22, comprising further a rupture disk on the second attachment, to block then allow the material to flow in the second path and through the third zone directly inside the tube.

25. The apparatus of claim 14, wherein the deflating means is an opening at the extremity of the first attachment allowing deflation of the first sleeve.

* * * * *